US005643204A

United States Patent [19]

Cover

[11] Patent Number: 5,643,204

[45] Date of Patent: Jul. 1, 1997

[54] PILL SWALLOWING DEVICE AND METHOD

[76] Inventor: Charles L. Cover, 633 Charles Hamilton Dr., Collierville, Tenn. 38017

[21] Appl. No.: 616,680

[22] Filed: Mar. 15, 1996

[51] Int. Cl.[6] ..... A61J 7/00

[52] U.S. Cl. ..... 604/77; 604/57

[58] Field of Search ..... 604/77, 79, 48, 604/57

[56] References Cited

U.S. PATENT DOCUMENTS 5,195,513 3/1993 Sinko et al. ..... 604/79 X

*Primary Examiner*—Robert A. Hafer
*Assistant Examiner*—N. Kent Gring
*Attorney, Agent, or Firm*—Stetina Brunda & Buyan

[57] ABSTRACT

An intra-oral device for facilitating pill swallowing includes a flexible shield sized as a flat pattern, that is configured to be formed so as to cover a substantial portion of the roof of the user's mouth. The flexible shield also preferably extends so as to overlap at least a portion of a pair of opposing upper teeth, thus securing the device in place. Upon positioning the shield inside the user's mouth to cover the roof portion thereof, and placing one or more pills between the user's tongue and the shield, swallowing may occur without the pills contacting the roof of the user's mouth. This avoids the touch sensation of large, irregularly-shaped and dense capsules and tablets, which is believed to evoke a nervous response by the user that inhabits the swallowing of pills. Alternatively, the intra-oral device includes a preformed, rigid shield, that is custom fit to conform to the shape of the upper portion of the particular user's mouth. The pill swallowing device and method have widespread application for the large number of individuals who experience difficulty in the swallowing of pills.

14 Claims, 1 Drawing Sheet

PILL SWALLOWING DEVICE AND METHOD

FIELD OF THE INVENTION

The present invention relates generally to intra-oral devices and methods to facilitate pill swallowing, and more particularly to such a device configured for placement against the upper portion of the user's mouth, for use in the swallowing of pills without the pills contacting the roof of the user's mouth.

BACKGROUND OF THE INVENTION

It is well known that many individuals have difficulty swallowing pills, particularly people over age 50 and children. It is estimated that 10% of young adults have a problem swallowing pills, and problems often increase with age due to medical conditions such as a stroke or inadequate saliva.

There are differing beliefs as to why healthy individuals have trouble in swallowing pills. Some attribute the difficulty to the large size of many capsules or dense make-up of most tablets. Applicant believes the swallowing of pills is impeded by the sensitivity of the roof of an individual's mouth and the different feel associated with pills as opposed to food.

Suppliers of oral medications have made numerous attempts to overcome the difficulties of pill swallowing. Spray and liquid medications are sometimes an alternative, but many drugs are not soluble in water, or their taste is very unpleasant. Most individuals also consider rectal administration of medication to be unpleasant. Under development is reported to be pills that dissolve in an individual's mouth, including appealing flavoring.

Other devices have also been proposed to facilitate the swallowing of pills. For example, pill crushers are available for cutting and smashing tablets, but pharmacists warn that some pills should not be crushed. Some pills have a coating to cover an unpleasant taste, and other pills, if crushed, may irritate the lining of an individual's mouth. Importantly, in some instances crushing pills eliminates their sustained-release action, or their ability to be released only at certain sites in the body such as the intestine.

Other methods reported to make medicine go down more easily include: drinking a glass of water first to make the tongue more slippery; putting the tablet as far back on the tongue as possible to speed its journey; standing up while taking the pill to work with gravity; eating ice cream or something equally cold first; and, eating the pill in combination with applesauce or the like. These methods are helpful to some, but ineffective or not feasible for use by others.

As such, new devices and methods with widespread applicability are needed for those continuing to experience difficulty in the swallowing of pills.

SUMMARY OF THE INVENTION

The present invention specifically addresses the above-identified needs of those individuals having difficulty in the swallowing of pills. More particularly, the present invention comprises a device that is placed inside a user's mouth to facilitate pill swallowing. The device includes a shield of a flexible material that is cut to size and formed to cover the roof of the user's mouth. Optionally, the flexible shield may extend to additionally overlap a portion of a pair of opposing upper teeth in the user's mouth, to help retain the sheet in place. In this way, upon subsequently placing one or more pills in the user's mouth between the user's tongue and the sheet, pill swallowing is unhindered by the pills contacting the roof of the user's mouth.

In an alternate embodiment of the invention, the device comprises a rigid shield, preformed to similarly cover the upper portion of a user's mouth and be retained thereto. Again, in taking medication orally, the pills will not directly contact the roof of the user's mouth, producing a touch sensation that tends to interfere with swallowing.

These, as well as other, advantages of the present invention will become more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The pill swallowing device and method of the present invention are illustrated in FIGS. 1–6, which depict presently preferred embodiments of the invention. Referring first to FIGS. 1–4, a flexible shield 10, and use thereof, according the preferred embodiment are shown. The flexible shield 10 is thin and pliable, and cut to a size to cover the upper roof portion of a user's mouth. In this way, it is possible for the user to place one or more pills between his or her tongue and the shield, for swallowing without the pills contacting the roof of his or her mouth.

It is the Applicant's contention that the touch sensation of large irregularly-shaped and dense capsules and tablets to the roof of an individual's mouth causes a nervous response. The nervous response causes involuntary contractions of small muscles in the aft portion of the user's tongue and in the user's throat, which interferes with the swallowing of the pills.

Continuing to refer to FIGS. 1–4, the flexible shield 10 and its use may be described in further detail. The flexible shield 10 is preferably fabricated of a polymer material having a thickness of approximately two-tenths of an inch, and tending to absorb water. The material of the flexible shield 10 should be easily manipulable into a shape that conforms to the upper surface of the user's mouth. A material having an affinity to water is preferred, as it is believed that it will more comfortably adhere to the roof portion of the user's mouth. Optionally, the material may be surface coated or impregnated with a pleasant flavoring. The flexible shield 12 is preferably of a resilient material, tending to return to its original flat shape after removal from the user's mouth. Optionally, the flexible shield 12 could be configured with an integral resilient frame consisting of a plastic member in cord form (not shown), that supports a floppy shield made of latex rubber material or the like.

Figure 1:
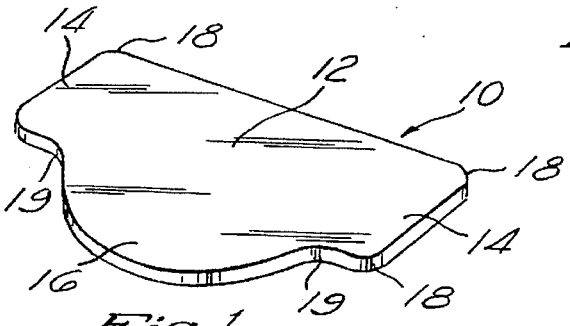
FIG. 1 is a perspective view illustrating a pill swallowing device in accordance with the present invention, embodied as a flexible shield and being shown in the form of a flat pattern.
Figure 2:
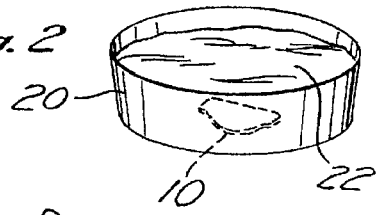
FIG. 2 is a perspective view illustrating the flexible shield soaking in a container of antiseptic solution.
Figure 3:
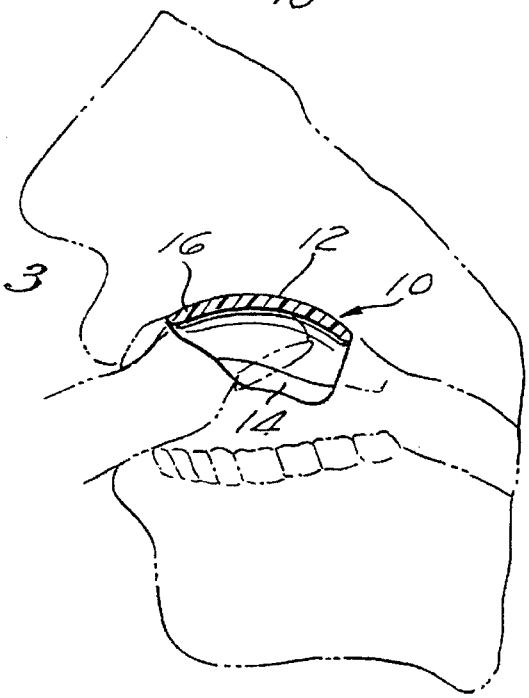
FIG. 3 is a side view showing insertion of the flexible shield of the preferred embodiment into a user's mouth.
Figure 4:
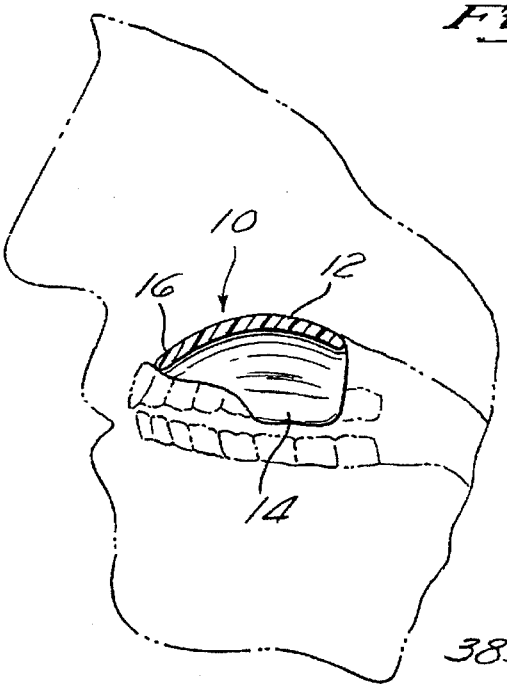
FIG. 4 is a side view showing the flexible shield of the preferred embodiment, as inserted into a user's mouth.

Referring to FIG. 1, the layout of the flexible shield 10 as a flat pattern is described. A flexible shield 10 is cut to size to have a rectangular middle section 12, extending to a pair of opposing outboard sections 14, and extending to a circular-bounded forward section 16. Around the perimeter of the flexible shield 10 are outer 18 and inner 19 radii, so as to avoid any sharp corners. The flexible shield 10 is cut to a size that fits 90% of all adults, and may optionally be cut to a smaller size for a child's mouth, particularly for children under the age of 12. The opposing outboard sections 14, upon installation, overlap at least the inboard surface of several of the user's rear upper teeth. This helps hold in place the middle 12 and forward 16 sections of the flexible shield 10 against the roof of the user's mouth. Additionally, the extended outboard sections 14 aid in preventing the flexible shield 10 from being inadvertently swallowed by the user. Optionally, the flexible shield 10 could include a retrieval strand (not shown), to dislodge the device should it ever get caught in the user's throat.

Figure 5:
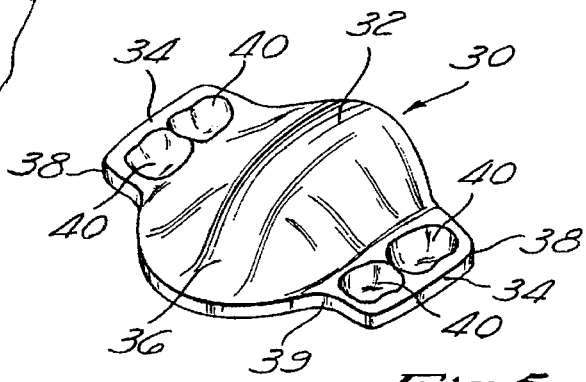
FIG. 5 is a perspective view of the rigid shield of the alternate embodiment.
Figure 6:
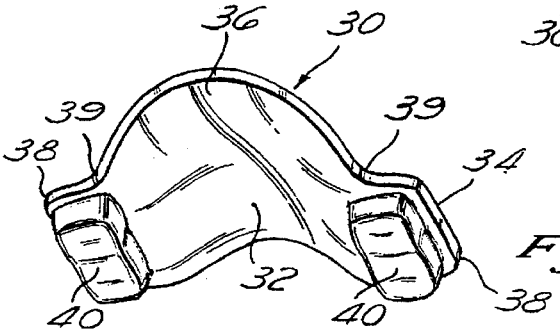
FIG. 6 is a reverse perspective view of the rigid shield of the alternate embodiment.

Now referring to FIGS. 5 and 6, an alternate embodiment including a rigid shield 30 may be described. The rigid shield 30 is preformed to a shape that corresponds to the upper surface of the user's mouth. The rigid shield 30 may be manufactured in several varying sizes, or it may be custom manufactured for each user from an impression taken from a particular user's mouth. The rigid shield 30 is preferably fabricated of a molded plastic material, that is impermeable to water as well as small particles greater than ten microns in diameter. The rigid shield 30 includes a cylindrically-shaped section 32, transitioning to a pair of opposing, substantially flat outboard sections 34, and transitioning to a compound-contoured forward section 36. The upper surface of the outboard sections 34 preferably includes a pair of cavities 40, corresponding to a pair of the user's upper rear teeth. Optionally, the cavities 40 could be replaced by mere perforations (not shown) in the flexible shield 30. The rigid shield 30 also includes rounded corners 38 and 39 around the perimeter.

Having described the structure of the preferred embodiments, their operation, function and use may now be described. The flexible shield 10 may be slightly manipulated to approximate the general shape of the upper portion of the user's mouth. Then, the flexible shield 10 is placed inside the user's mouth, and pushed against the roof portion to conform thereto. Alternatively, a rigid shield 30 may be used that is custom made and preformed to match that portion of the user's mouth. In use of either the flexible shield 10 or the rigid shield 30, it may be necessary to adjust the position of the shield to substantially cover the roof of the user's mouth, as well as to cover at least a portion of a pair of opposing upper teeth in the rear of the user's mouth. Once the shield 10 or 30 is securely in place, the user may place one or more pills between his or her tongue and the shield 10 or 30. Then, together with a glass of water or other liquid medium, the user should experience no difficulty in taking a drink and swallowing the pills, as the pills will not contact the roof of the user's mouth. During the swallowing of the pills, there will be no touch sensation to cause a nervous response. After use, the flexible shield 10 should be placed into a small container 20 containing antiseptic solution 22 or germicide (FIG. 2), to cleanse and prevent the growth of harmful micro-organisms on the flexible shield 10. Optionally, the flexible shield 10 may be sold several to a package, and disposed of after each use.

It is understood that the pill swallowing device and method described herein and shown in the drawings represent only presently preferred embodiments of the invention. Indeed, various modifications and additions may be made to the above-described embodiments without departing from the spirit and scope of the invention. These and other modifications and additions may be obvious to those skilled in the art and may be implemented to adapt the present invention for use in a variety of different applications.

What is claimed is:

1. A device for placement inside a user's mouth to facilitate pill swallowing, said device comprising:

a flexible shield sized and configured as a flat pattern that is formable to reside within the interior of the mouth to cover a substantial portion of the roof of the mouth for shielding said roof from a pill within the mouth and facilitating substantially complete closure of the mouth for swallowing.

2. The device of claim 1 wherein the shield is formed to also cover at least a portion of at least one pair of opposing upper teeth in the user's mouth.

3. The device of claim 2 wherein the shield covers opposing upper teeth in the aft portion of the user's mouth.

4. The device of claim 1 wherein the shield is resilient, returnable to the flat pattern after being formed to fit within the user's mouth.

5. The device of claim 1 wherein the shield is formed of a polymer material.

6. The device of claim 5 wherein the material is hydrophilic.

7. The device of claim 6 wherein the shield may be disinfected by placement in an antiseptic.

8. A device for placement inside a user's mouth to facilitate pill swallowing, said device comprising:

a substantially rigid shield formed to reside within the interior of the mouth and substantially cover the roof of said mouth for shielding said roof from a pill within the mouth and facilitating substantially complete closure of the mouth for swallowing, said shield additionally covering at least a portion of at least one pair of opposing upper teeth in the aft portion of the said mouth.

9. The device of claim 8 wherein the shield is of a molded plastic material.

10. The device of claim 8 wherein the material is hydrophobic.

11. A method for facilitating the swallowing of pills, the method comprising the steps of:

placing inside a user's mouth a flexible shield sized and configured as a flat pattern that is formable to reside within the interior of said mouth to cover a substantial portion of the roof of the mouth for shielding said roof from a pill within the mouth and facilitating substantially complete closure of the mouth for swallowing;

forming the shield to generally conform to the shape of the roof portion of the user's mouth; positioning the shield to substantially cover the roof of user's mouth;

placing one or more pills inside the user's mouth between the user's tongue and the shield; and swallowing the pills without the pills substantially contacting the roof of the user's mouth.

12. The method of claim 11 further comprising the step of:

positioning the shield to also cover at least a portion of at least a pair of opposing teeth in the user's mouth.

13. The method of claim 11 further comprising the steps of:

removing the shield from inside the user's mouth; and, placing the shield in an antiseptic solution to disinfect the shield.

14. A method for facilitating the swallowing of pills, the method comprising the steps of:

placing inside a user's mouth a substantially rigid shield formed to reside within the interior of said mouth and substantially cover the roof of said mouth for shielding said roof from a pill within the mouth and facilitating substantially complete closure of the mouth for swallowing, said shield additionally covering at least a portion of at least one pair of opposing upper teeth in the aft portion of said mouth;

placing the rigid shield inside the user's mouth; positioning the shield to substantially cover the roof portion and at least a portion of at least a pair of opposing upper teeth in the user's mouth;

placing one or more pills inside the user's mouth between the user's tongue and the shield; and swallowing the pills without the pills substantially contacting the roof of the user's mouth.

* * * * *